US008490233B2

(12) United States Patent
Essers

(10) Patent No.: US 8,490,233 B2
(45) Date of Patent: Jul. 23, 2013

(54) MATTRESS, IN PARTICULAR FOR USE IN THE CARE AND HOSPITAL SECTOR

(75) Inventor: Heinz-Willy Essers, Wassenberg (DE)

(73) Assignee: Heinrich Essers GmbH & Co. KG, Wassenberg (DE)

( * ) Notice: Subject to any disclaimer, the term of this patent is extended or adjusted under 35 U.S.C. 154(b) by 0 days.

(21) Appl. No.: 13/147,821

(22) PCT Filed: Jan. 20, 2010

(86) PCT No.: PCT/EP2010/000312

§ 371 (c)(1), (2), (4) Date: Aug. 4, 2011

(87) PCT Pub. No.: WO2010/089025

PCT Pub. Date: Aug. 12, 2010

(65) Prior Publication Data

US 2011/0283459 A1 Nov. 24, 2011

(30) Foreign Application Priority Data

Feb. 5, 2009 (DE) ..... 10 2009 007 651
Mar. 20, 2009 (DE) ..... 10 2009 014 265

(51) Int. Cl.
*A47C 27/22* (2006.01)
*A47C 27/15* (2006.01)
*A61G 7/057* (2006.01)

(52) U.S. Cl.
USPC ..... 5/724; 5/726; 5/727; 5/738

(58) Field of Classification Search
USPC ..... 5/724, 726, 652.1, 699, 727, 737, 5/738
See application file for complete search history.

(56) References Cited

U.S. PATENT DOCUMENTS

| | | | | |
|---|---|---|---|---|
| 5,870,785 | A * | 2/1999 | Hoorens | 5/652.1 |
| 7,191,480 | B2 * | 3/2007 | Romano et al. | 5/690 |
| 7,469,432 | B2 * | 12/2008 | Chambers | 5/423 |
| 8,191,187 | B2 * | 6/2012 | Brykalski et al. | 5/423 |
| 2005/0086739 | A1 * | 4/2005 | Wu | 5/423 |
| 2007/0251016 | A1 | 11/2007 | Feher | |
| 2008/0263776 | A1 * | 10/2008 | O'Reagan et al. | 5/714 |
| 2010/0122417 | A1 * | 5/2010 | Vrzalik et al. | 5/652.1 |

FOREIGN PATENT DOCUMENTS

| | | | |
|---|---|---|---|
| DE | 691 15 696 | T2 | 8/1996 |
| DE | 203 09 793 | U1 | 10/2003 |
| DE | 203 09 795 | U1 | 10/2003 |
| DE | 10 2004 037625 | A1 | 3/2006 |
| DE | 10 2005 029 755 | A1 | 12/2006 |
| DE | 100 26 405 | B4 | 2/2008 |
| DE | 10 2007 059 274 | A1 | 6/2009 |
| EP | 1 987 806 | A2 | 11/2008 |
| GB | 15 96 158 | A | 8/1981 |
| GB | 2 353 048 | A | 2/2001 |
| NL | 1 003 779 | C2 | 2/1998 |
| WO | 2007/034311 | A2 | 3/2007 |

* cited by examiner

*Primary Examiner* — Michael Trettel

(74) *Attorney, Agent, or Firm* — McGlew and Tuttle, P.C.

(57) ABSTRACT

A mattress, in particular for use in the care and hospital sector, has a base layer and a top layer arranged thereon. The top layer is formed by a resilient knitted spacer fabric, which is covered by a top layer cover. The top layer cover has a liquid-impermeable top layer cover lower part and a liquid-permeable top layer cover upper part. The mattress allows simple and frequent reprocessing.

24 Claims, 5 Drawing Sheets

MATTRESS, IN PARTICULAR FOR USE IN THE CARE AND HOSPITAL SECTOR

CROSS REFERENCE TO RELATED APPLICATIONS

This application is a United States National Phase application of International Application PCT/EP2010/000312 and claims the benefit of priority under 35 U.S.C. §119 of German Patent Application, Serial No. 10 2009 007 651.4, filed Feb. 5, 2009, and German Patent Application, Serial No. 10 2009 014 265.7, filed Mar. 20, 2009, the entire contents of which are incorporated herein by reference.

FIELD OF THE INVENTION

The invention relates to a mattress, in particular for use in the care and hospital sector.

BACKGROUND OF THE INVENTION

For use in the care and hospital sector, mattresses have to satisfy a large number of requirements. Apart from comfortable lying properties, mattresses of this type have to be robust and easy to clean, so frequent reprocessing is possible.

SUMMARY OF THE INVENTION

The invention is therefore based on an object of providing a comfortable mattress, which allows frequent and simple reprocessing.

This object is achieved by a mattress, in particular for use in the care and hospital sector, with a resilient base layer, a top layer arranged on the base layer, comprising a resilient knitted spacer fabric and a top layer cover covering the knitted spacer fabric with a liquid-impermeable top layer cover lower part facing the base layer and a liquid-permeable top layer cover upper part remote from the base layer.

Liquids can flow away from the lying surface into the interior of the knitted spacer fabric through the liquid-permeable top layer cover upper part being used as the lying surface. Because of the liquid-impermeable top layer cover lower part facing the base layer, the liquid from the interior of the knitted spacer fabric cannot flow away in the direction of the base layer, so soiling of the base layer is avoided. In conjunction with the resilient knitted spacer fabric, the resilient base layer provides a high degree of lying comfort, the knitted spacer fabric, in conjunction with the top layer cover, absorbing liquids from the lying surface. To reprocess the mattress, the top layer with the knitted spacer fabric and the top layer cover merely has to be cleaned. Both the knitted spacer fabric and the top layer cover are adequately robust for an adequate number of cleaning operations. Moreover, the entire mattress is simply constructed and can accordingly be economically produced. The top layer may have a one-part or multi-part configuration. The top layer cover lower part, for example, consists of polyester with an outer polyurethane coating. The top layer cover upper part is configured as a knitted product and consists, for example, of polyester. Moreover, the top layer may be formed in such a way that a plurality of knitted spacer fabrics is arranged next to one another and/or one above the other. The knitted spacer fabrics may be covered by a joint top layer cover. Alternatively, a plurality of top layer covers may be provided, which in each case cover one and/or more knitted spacer fabrics.

A mattress, in which the top layer cover is removable from the knitted spacer fabric, is extremely easy to clean, as the top layer cover and the knitted spacer fabric can be cleaned separately from one another.

A mattress, in which the top layer cover lower part and the top layer cover upper part are connected to one another by a top layer cover zip fastener, allows simple handling during cleaning. A lip concealing the top layer cover zip fastener may be arranged above the top layer cover zip fastener, in other words toward the lying surface. Alternatively, a lip concealing the top layer cover zip fastener may in each case be arranged above and below the top layer cover zip fastener. As a result, soiling of the top layer cover zip fastener by liquids, such as, for example, blood, can be avoided. Moreover, catching on the top layer cover zip fastener is prevented.

A mattress, in which the top layer cover lower part is configured in the form of a trough, allows the storage of a large quantity of liquid, without it escaping laterally. The top layer cover lower part preferably has liquid-impermeable side cheeks, which reach to the level of the top layer cover zip fastener.

A mattress, in which the base layer has a resilient shaped body and a water-impermeable base layer cover covering the latter, protects the shaped body from soiling, when liquid undesirably escapes from the top layer, for example if the top layer cover lower part is damaged. The base layer cover is formed as an incontinence cover and, for example, consists of polyester with an outer polyurethane coating. The shaped body may have a one-part or multi-part configuration, it being possible for a plurality of shaped bodies to be covered by one or more base layer covers. Moreover, the base layer may be formed in such a way that a plurality of shaped bodies is arranged next to one another and/or one above the other. The shaped bodies may be covered by a joint base layer cover. Alternatively, a plurality of base layer covers may be provided, each covering one and/or more shaped bodies. The shaped body may be formed from a processable and/or air- and moisture-permeable and/or a resilient material, such as, for example, a reticulated foam.

A mattress, in which the shaped body is made of foam, is simply constructed and economical.

A mattress, in which the base layer cover is removable from the shaped body, allows easy cleaning of the shaped body.

A mattress, in which the base layer cover has a base layer cover zip fastener for removal from the shaped body, allows easy handling when the shaped body is cleaned. A lip concealing the base layer cover zip fastener may be arranged above the base layer cover zip fastener, in other words toward the top layer. Alternatively, a lip concealing the base layer cover zip fastener may be arranged above and below the base layer cover zip fastener, in each case. As a result, soiling of the base layer cover zip fastener by liquids, such as, for example, blood, can be avoided. Moreover, catching on the base layer cover zip fastener is avoided.

A mattress according, in which the base layer and the top layer are detachably connected to one another, on the one hand, provides a high degree of stability and, on the other hand, easy handleability both during cleaning and during a bed change of the mattress. The detachable connection takes place by means of detachable fixing elements, such as, for example, slipcovers, push buttons, hook and loop fasteners, zip fasteners and/or sliding clips.

A mattress, in which the knitted spacer fabric has two covering layers connected to one another by spacer threads, the spacer threads forming spacer thread groups with an IXI-shape and extending in a plane, is extremely robust and comfortable. The knitted spacer fabric, because of the IXI-shape of the large number of spacer thread groups, has a high elasticity of compression and dimensional stability. Pressure loads can be resiliently absorbed by the spacer threads, these returning to the original shape once the pressure load has been removed. Because of the high dimensional stability, the knitted spacer fabric can be formed with a height of 2 to 100 mm, in particular from 8 to 100 mm and, in particular, 15 to 55 mm, without the latter permanently deforming because of the pressure loads.

A mattress, in which the knitted spacer fabric has a plurality of zones in an x-direction, which have at least partially different densities in such a way that the knitted spacer fabric has at least partially different compression hardnesses in the zones, allows body support regions to be formed with different compression hardnesses. As a result, the pressure distribution of the top layer can be optimized.

A mattress, in which a plurality of knitted spacer fabrics are arranged in a shear-resistant manner one above another in a y-direction, improves the soft support and lying comfort. The soft support is between 10 and 25 mm/HG. HG is the abbreviation for mercury and in this context means that the pressure is given based on mercury, in other words per mm mercury column.

The total height of the knitted spacer fabrics arranged one above the other is between 5 mm and 150 mm. The knitted spacer fabrics may have the same or different compression hardnesses. Moreover, individual knitted spacer fabrics or all of them may have a plurality of zones in accordance with the invention. Adjacent knitted spacer fabrics are arranged in a shear-resistant manner with respect to one another in an x- and a z-direction. The shear-resistant arrangement can be achieved by slip-inhibiting coatings, seam, weld, adhesive and/or joint connections.

A mattress, in which a plurality of knitted spacer fabrics is arranged next to one another in an x-direction, allows a configuration of the top layer with different compression hardnesses in the x-direction. Each knitted spacer fabric preferably has a homogeneous density, it being possible for the densities of the knitted spacer fabrics to vary with respect to one another. The knitted spacer fabrics may be covered by a joint top layer cover, which holds them together in a slip-resistant manner. Alternatively, individual knitted spacer fabrics or all of them may be covered by their own top layer cover. The top layer covers may be formed differently. For example, top layer covers, the associated knitted spacer fabrics of which are arranged in regions of the mattress where liquid is expected to occur, may be formed in accordance with the invention. In comparison, top layer covers, the associated knitted spacer fabrics of which in regions of the mattress, in which liquid is not expected to occur, may be formed differently from the invention. Regions of this type may, for example, be the head and foot region. In regions of this type, the top layer cover lower part and/or the top layer cover upper part may be liquid-impermeable and/or liquid-permeable. Liquid-impermeable top layer cover parts are preferably in the form of a trough in accordance with the invention. The outlay for care and cleaning, in particular, during the reprocessing in the problem regions of the body to be supported can be reduced by a plurality of knitted spacer fabrics arranged next to one another.

A mattress, in which all the knitted spacer fabrics are covered by precisely one top layer cover, allows a flexible and stable structure of the top layer. Since all the knitted spacer fabrics arranged next to one another and/or above one another are covered by a joint top layer cover, these are fixed relative to one another.

A mattress, in which a plurality of top layer covers is provided to cover the knitted spacer fabrics, allows a flexible structure in accordance with need of the top layer. Since a plurality of top layer covers cover the knitted spacer fabrics, the top layer can be flexibly adapted to the degree of soiling in the various regions. In regions with a high degree of soiling, the corresponding top layer cover is formed in such a way that liquids can be guided away into the interior of the knitted spacer fabric(s) and cannot escape again therefrom. In the regions with a low degree of soiling, such as, for example, in the head or foot region, for reasons of cost—depending on need—a different formation of the corresponding top layer cover may be provided. A top layer cover may cover a single knitted spacer fabric. Alternatively, a top layer cover may cover a plurality of knitted spacer fabrics, which are arranged next to and/or above one another.

A mattress, in which the top layer has a moisture-absorbent material layer, in a simple manner, allows the binding of liquid or moisture. The material layer may be arranged on the side of the top layer facing the lying surface or facing the base layer inside the top layer cover or top layer covers. The material layer may, for example, be made of nonwoven or another suitable material. The material layer is preferably arranged in the top layer cover lower part formed as a trough.

A mattress, in which the top layer has a germicidal material layer, corresponds to high hygiene requirements. The germicidal material layer may be germ-sealing or germ-destroying. The germicidal material layer is preferably simultaneously moisture-absorbent.

The top layer can be individually adapted to a body shape by means of a mattress, in which the knitted spacer fabric is hot-formed for adaptation to a body shape. As a result, in the case of complicated breaks, the corresponding body part is stabilized and/or a trough for lying is formed. After hot forming, the surface shape of the covering layer of the knitted spacer fabric remains stable, the resilience of the knitted spacer fabric being retained. By means of reheating, the hot forming is reversible. With regard to the hot forming of the knitted spacer fabric, reference is made to DE 10 2005 029 755 A1.

A mattress, in which the top layer has a moisture sensor, ensures detection of rapid liquid or moisture increases to assist telemedicine. Depending on need, one or more liquid sensors may be provided. The liquid sensors may be arranged within the knitted spacer fabric(s) and/or on an inside of the top layer cover lower part and/or the top layer cover upper part. Furthermore, moisture sensors may alternatively or additionally be arranged on an outside of the top layer cover upper part, in other words on the lying surface.

A mattress in which a ventilation device, in particular a suction device, is provided for ventilating the top layer, allows an active supply of air into the knitted spacer fabric(s). The supplied air is preferably adapted to the body temperature. The ventilation device may, for example, be formed as a pump and/or suction device for ventilating or venting the top layer. The ventilating and venting and the suction may take place by any number of inlet and outlet valves, which are preferably arranged close to the support region, in other words in the region of the upper side of the top layer in the front end, foot and side cheeks of the top layer cover. The valves are activated, for example, by introducing hollow release inserts into the valves. Furthermore diaphragms may also be used, for example, as inlet and outlet valves. The valves are connected by an associated supply and removal line to the ventilation device or suction device. The ventilation device is preferably controlled as a function of the moisture sensor according to the invention.

A mattress, in which a plurality of shaped bodies is arranged in a shear-resistant manner one above the other in a y-direction, allows a flexible structure of the base layer with different strength zones in the y-direction. To cover the shaped body, a joint base layer cover is preferably provided. Alternatively, a plurality of base layer covers may be provided.

A mattress, in which a plurality of shaped bodies is arranged next to one another in an x-direction, allows a flexible structure of the base layer with different strength zones in the x-direction. A joint base layer cover is preferably provided to surround the base body. Alternatively, a plurality of base body covers may be provided.

Further features, advantages and details of the invention emerge from the following description of a plurality of embodiments.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
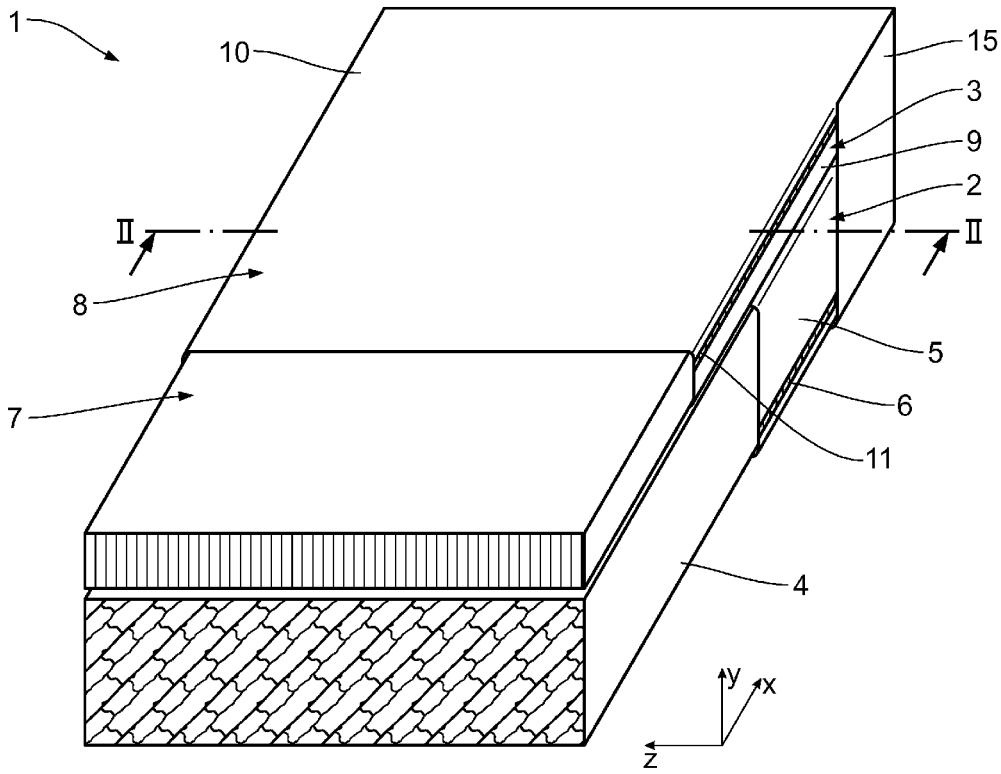
FIG. 1 is a perspective and partly sectional view of a mattress for use in the care and hospital sector according to a first embodiment.
Figure 2:
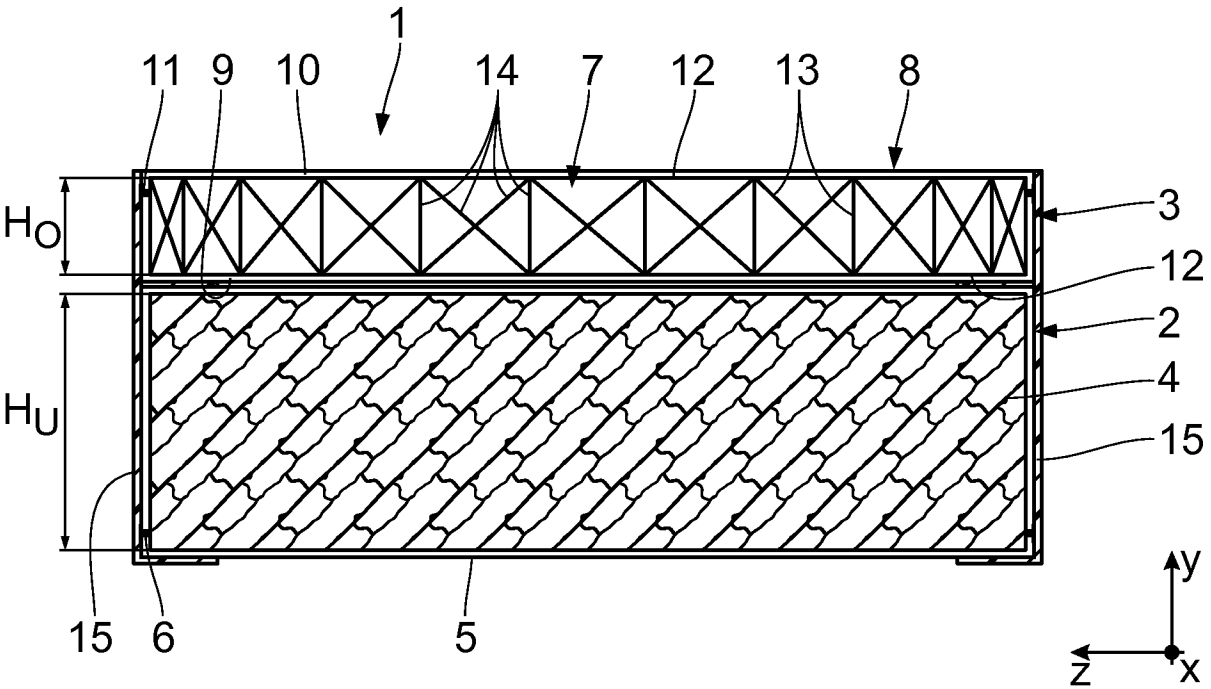
FIG. 2 is a sectional view through the mattress in FIG. 1 along the section line II-II.

A first embodiment of the invention will be described below with the aid of FIGS. 1 and 2. A mattress 1 for use in the care and hospital sector has a base layer 2 and a top layer 3 arranged thereon. The base layer 2 and the top layer 3 extend substantially in an x- and a z-direction, the top layer 3 in a y-direction being arranged on the base layer 2. The x-, y- and z-directions run perpendicular to one another and form a coordinates system.

The base layer 2 is formed by a resilient shaped body 4, which is completely surrounded by a liquid-impermeable base layer cover 5. The shaped body 4 consists of foam and has a height $H_U$ in the region of, for example, 6 to 14 cm. The height $H_U$ of the shaped body 4 depends on the total construction height of the base layer 2 and the top layer 3 together. The base layer cover 5—in a processable variant of the shaped body 4—is provided with a base layer zip fastener 6 at least partially running around it, so the base layer cover 5 can be removed from the shaped body 4. The base layer cover 5 is formed as an incontinence cover and, for example, consists of polyester with an outer polyurethane coating. If the shaped body 4 cannot be processed, the base layer cover 5 is optionally not provided with a base layer zip fastener 6. A one-sided or two-sided lip may be arranged above the base layer cover zip fastener 6, in other words toward the top layer 3. The top layer 3 is formed by a knitted spacer fabric 7, which is completely covered by a top layer cover 8. The top layer cover 8 has a liquid-impermeable top layer cover lower part 9 facing the base layer 2 and a liquid- and air-permeable top layer cover upper part 10, which is remote from the base layer 2 and forms a lying surface. The top layer cover 8 has a top layer cover zip fastener 11 at least partially running around it, so the top layer cover 8 can be removed from the knitted spacer fabric 7. The top layer cover lower part 9 is formed as a water-impermeable trough to avoid a lateral escape of liquid. The top layer cover lower part 9 consists, for example, of polyester with an outer polyurethane coating. The top layer cover upper part 10 is formed as a conventional commercial knitted product and, for example, consists of polyester. The top layer cover lower part 9 preferably has liquid-impermeable side cheeks, which extend to the height of the top layer cover zip fastener 11.

The knitted spacer fabric 7 has two covering layers 12 which extend parallel to one another and are connected to one another by spacer threads 13. The spacer threads 13 form spacer thread groups 14 extending in a plane, which have an IXI shape. This is shown in FIG. 2. The IXI shape is formed by two spacer threads 13 extending perpendicular to the covering layers 12 and two spacer threads 13 extending obliquely, for example at an angle of 45°, and intersecting. The knitted spacer fabric 7 has a height $H_O$ in the range from 2 to 100 mm, in particular from 8 to 100 mm and in particular from 15 to 55 mm. The threads of the cover layers 12 and/or the spacer threads 13 can be formed as monofilaments and/or multi-filaments and consist of polyester, for example. With regard to the structure and the material of the knitted spacer fabric 7, reference is made to DE 100 26 405 B4.

The knitted spacer fabric 7 is distinguished by a good pressure relief and pressure distribution and high point-resilience. Owing to the open structure of the knitted spacer fabric 7, liquids are guided away from the lying surface into the interior. For example, body fluids of patients are guided away from the body. Moreover, the knitted spacer fabric 7 has a good microclimate and good heat and moisture exchange, as it acts as a passive pump and, for example, allows a supply and removal of oxygen upon a body movement. With a corresponding selection of material, the knitted spacer fabric 7 is completely recyclable.

A fixing element 15, which is in the form of a slipcover, is fixed to each corner of the mattress 1 on the top layer covering 8. The base layer 2 is inserted into the fixing elements 15, so that the base layer 2 and the top layer 3 are detachably connected to one another.

The top layer cover upper part 10 provides a lying surface, for example for a patient in a hospital. Liquids located on the top layer cover upper part 10 pass through the latter into the interior of the knitted spacer fabric 7, the liquids being prevented by the trough-shaped top layer cover lower part 9 from escaping again in the direction of the base layer 2.

To process the mattress 1 after soiling, the top layer 3 together with the fixing elements 15 is separated from the base layer 2. By opening the top layer cover zip fastener 11, the knitted spacer fabric 7 can be removed from the top layer cover 8. The top layer cover 8 with the fixing elements 15 and the knitted spacer fabric 7 can now be cleaned separately from one another. If the soiling is too heavy or excess wear has occurred, the knitted spacer fabric 7 and/or the top layer cover 8 can be replaced.

To clean the base layer 2, the base layer cover zip fastener 6 is opened and the shaped body 4 is removed from the base layer cover 5. The shaped body 4—if a suitable material was selected for it—and the base layer cover 5 can now be cleaned separately from one another. If the soiling is too heavy or excess wear has occurred, the shaped body 4 and/or the base layer cover 5 can be replaced. The base layer 2 has to be cleaned much less often than the top layer 3 because of the trough-shaped top layer cover lower part 9.

The mattress 1 is comfortable and easy to clean because of the flexibility in the cleaning. Moreover, the most varied individual parts can be cleaned or replaced separately.

Figure 3:
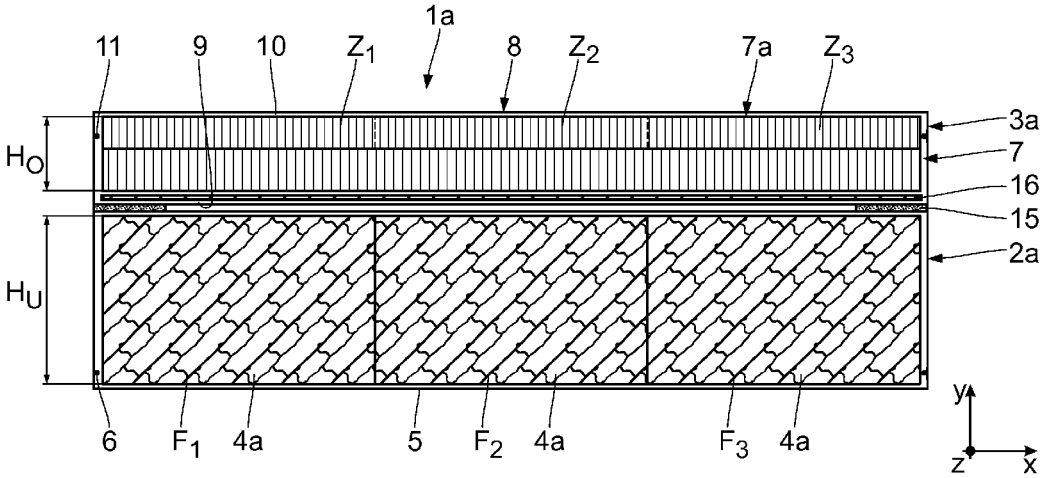
FIG. 3 is a longitudinal sectional view through a mattress according to a second embodiment.

A second embodiment of the invention will be described below with reference to FIG. 3. Structurally identical parts receive the same reference numerals as in the first embodiment, to the description of which reference is hereby made. Structurally different, but functionally similar parts receive the same reference numerals with an a placed thereafter. The first knitted spacer fabric 7*a* is divided into three zones $Z_1$ to $Z_3$, which are arranged next to one another in the x-direction. The zones $Z_1$ to $Z_3$ have different densities from one another, so different compression hardnesses are formed. The density for each of the zones $Z_1$ to $Z_3$ is homogeneous per se. The first knitted spacer fabric 7*a* is arranged in a shear-resistant manner on a second knitted spacer fabric 7 in the x- and z-direction. The second knitted spacer fabric 7 is formed in accordance with the first embodiment and has a homogeneous density. Since the knitted spacer fabrics 7, 7*a* are arranged one above the other, a greater overall height $H_O$ is achieved. A moisture-absorbent and germicidal material layer 16 is arranged between the second knitted spacer fabric 7 and the top layer cover lower part 9. The material layer 16 absorbs liquid that collects in the trough-shaped top layer cover lower part 9 and substantially destroys germs contained therein. The knitted spacer fabrics 7, 7*a* and the material layer 16 are covered by a joint top layer cover 8. The base layer 2*a* has three shaped bodies 4*a*, which are arranged next to one another and form the different strength zones $F_1$ to $F_3$. The shaped bodies 4*a* are covered by a joint base layer cover 5. With regard to the further mode of functioning, reference is made to the first embodiment.

Figure 4:
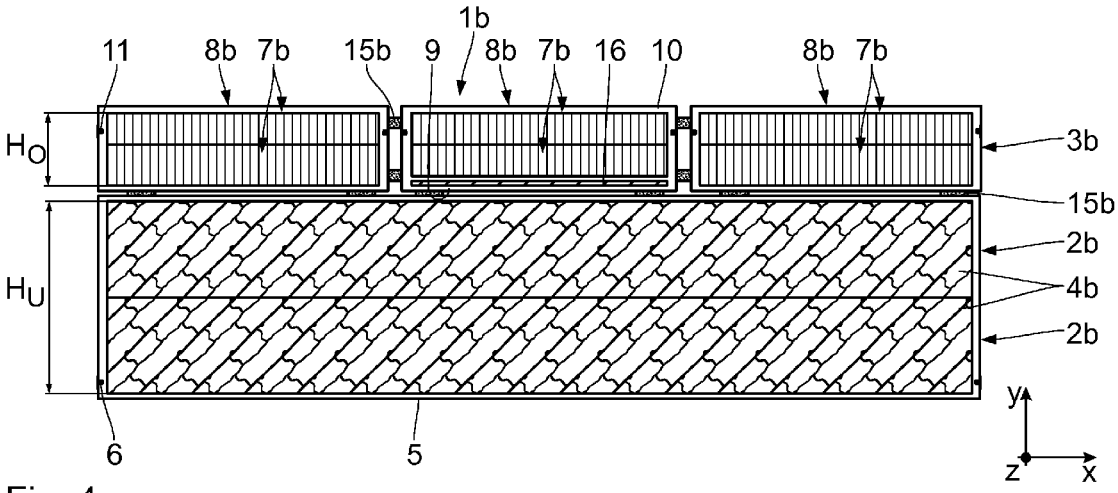
FIG. 4 is a longitudinal sectional view through a mattress according to a third embodiment.

A third embodiment of the invention will be described below with reference to FIG. 4. Structurally identical parts receive the same reference numerals as in the preceding embodiments, to the description of which reference is hereby made. Structurally different, but functionally similar parts receive the same reference numerals with a b placed thereafter. The mattress 1*b* has a total of six knitted spacer fabrics 7*b*, which are arranged in pairs in a shear-resistant manner one above the other and are covered in pairs by a respective top layer cover 8*b*. The knitted spacer fabrics 7*b*, as needed, may have different densities, so that different compression hardnesses can be produced. The moisture-absorbent and germicidal material layer 16 is arranged in the center region of the mattress 1*b* between the knitted spacer fabric 7*b* and the top layer cover lower part 9. A high degree of soiling is to be expected in the center region. Accordingly, the top layer cover lower part 9—as described in the preceding embodiments—is trough-shaped. The top layer covers 8*b* in the further regions of the mattress 1*b* may be formed as needed. The top layer covers 8*b* are connected to the base layer cover 5 and to one another by fixing elements 15*b* in the form of hook and loop tapes. The base layer 2*b* has two shaped bodies 4*b* arranged one above the other in the y-direction and in a shear-resistant manner with respect to one another in the x- and z-direction. Since these are arranged one above the other, a higher total height $H_U$ can be achieved. The shaped bodies 4*b* are covered by a joint base layer cover 5. With regard to the further mode of functioning, reference is made to the preceding embodiments.

Figure 5:
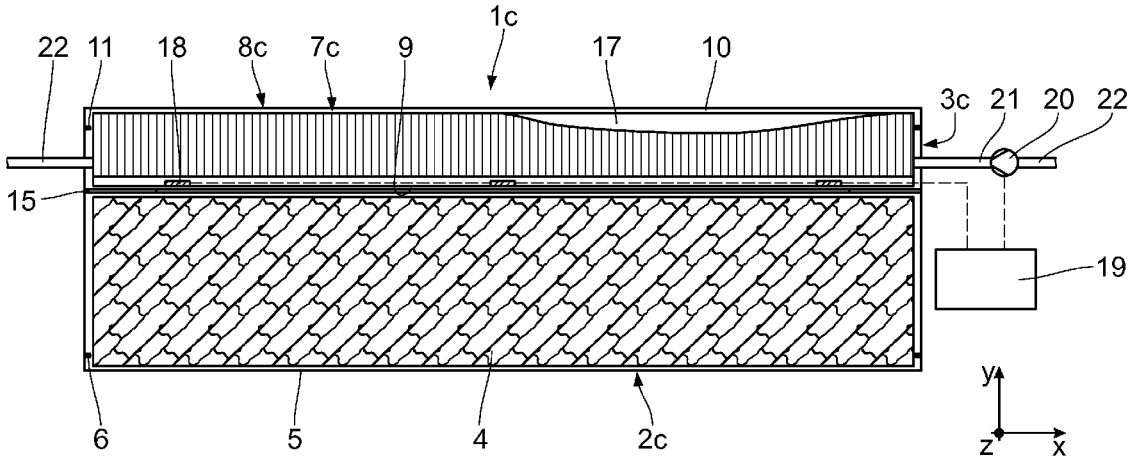
FIG. 5 is a longitudinal sectional view through a mattress according to a fourth embodiment.

A fourth embodiment of the invention will be described below with reference to FIG. 5. Identical parts receive the same reference numerals as in the preceding embodiments, to the description of which reference is hereby made. Structurally different, but functionally similar parts receive the same reference numerals with a c placed thereafter. The knitted spacer fabric 7*c* is hot-formed and has a lying trough 17. Body parts can be stabilized by the lying trough 17. A moisture sensor 18 is arranged, in each case, between the knitted spacer fabric 7*c* and the top layer cover 8*c* in the head, center and foot region. The moisture sensors 18 are connected via signal lines to a control unit 19. Furthermore, a ventilation device 20 in the form of a pump and/or suction device is connected to the control unit 19 by a signal line. The ventilation device 20 is connected by a supply line 21 and a removal line 22 at opposing end faces to the top layer cover 8*c*. If one of the moisture sensors 18 detects liquid or moisture in the trough-shaped top layer cover lower part 9, a signal is transmitted to the control unit 19. The control unit 19 then emits a warning signal for the care or hospital staff. Furthermore, a control unit 19 controls the ventilation device 20 as needed. By means of the ventilation device 20, air adapted to the body temperature is pumped into the top layer 3*c*, so that a constant air circulation or one that is controlled as needed takes place. The mattress 1*c* therefore assists telemedicine. Reference is made to the preceding embodiments with regard to the further mode of functioning.

In principle, the following applies:

The top layer 3 may be formed in such a way that a plurality of knitted spacer fabrics 7 is arranged next to and/or above one another. The knitted spacer fabrics 7 may be covered by a joint top layer cover 8. Alternatively, a plurality of top layer covers 8 may be provided, which in each case cover one and/or more knitted spacer fabrics 7.

Alternatively or additionally, the base layer 2 may be formed in such a way that a plurality of shaped bodies 4, are arranged next to and/or above one another. The shaped bodies 4 may be covered by a joint base layer cover 5. Alternatively, a plurality of base layer covers 5 may be provided, which in each case cover one and/or more shaped bodies 4. Furthermore, each knitted spacer fabric 7 may be formed with a homogeneous density, it being possible for the knitted spacer fabrics 7 to have different homogeneous densities from one another. Alternatively, the knitted spacer fabric 7 may have a plurality of zones Z with different densities.

Furthermore, mattress 1 may have an independent lengthening piece attached at the foot end. This ensures additional leg freedom and may moreover serve as a soft support zone for the heel region.

Moreover, a shaped body 4, for example made of foam, may also be arranged in the top layer 3, in addition to the knitted spacer fabric(s) 7, toward the base layer 2. Both the base layer 2 and the top layer 3 may additionally have the moisture-absorbent and/or germicidal material layer 16.

Each top layer cover 8 may have an associated top layer cover zip fastener 11. Accordingly, each base layer cover 5 may have an associated base layer cover zip fastener 6. The top layer cover zip fastener 11 and/or the base layer cover zip fastener 6 may be formed covered by a one-sided and/or two-sided lip, so the top layer cover zip fastener 11 and/or the base layer cover zip fastener 6 are protected from soiling. The lips may be formed in one piece with the top layer cover 8 and/or the base layer cover 5.

Depending on the desired cleaning possibility, the top layer covers 8 and/or the base layer covers 5 may have opening possibilities, for example in the form of zip fasteners. An opening possibility is advantageous in particular when the respective top layer cover 8 or base layer cover 5 is liquid-permeable.

While specific embodiments of the invention have been described in detail to illustrate the application of the principles of the invention, it will be understood that the invention may be embodied otherwise without departing from such principles.

The invention claimed is:

1. A mattress, comprising:

a resilient base layer;

a top layer arranged on the base layer, said top layer comprising a resilient knitted spacer fabric and a top layer cover covering the knitted spacer fabric with a liquid-impermeable top layer cover lower part facing the base layer and a liquid-permeable top layer cover upper part remote from the base layer, said knitted spacer fabric having two covering layers connected to one another by spacer threads, said spacer threads forming spacer thread groups with an IXI-shape and said spacer thread groups extending in a plane, wherein said top layer cover lower part is configured in a form of a trough.

2. A mattress according to claim 1, wherein the top layer cover is removable from the knitted spacer fabric.

3. A mattress according to claim 2, wherein the top layer cover lower part and the top layer cover upper part are connected to one another by a top layer cover zip fastener.

4. A mattress according to claim 1, wherein the base layer has a resilient shaped body and a water-impermeable base layer cover covering said resilient shaped body.

5. A mattress according to claim 4, wherein the shaped body is made of foam.

6. A mattress according to claim 4, wherein the base layer cover is removable from the shaped body.

7. A mattress according to claim 6, wherein the base layer cover has a base layer cover zip fastener for removal from the shaped body.

8. A mattress according to claim 1, wherein the base layer and the top layer are detachably connected to one another.

9. A mattress according to claim 1, wherein the knitted spacer fabric has a plurality of zones in an x-direction, which have at least partially different densities in such a way that the knitted spacer fabric has at least partially different compression hardnesses in the zones.

10. A mattress according to claim 1, wherein a plurality of knitted spacer fabrics are arranged in a shear-resistant manner one above another in a y-direction.

11. A mattress according to claim 1, wherein a plurality of knitted spacer fabrics is arranged next to one another in an x-direction.

12. A mattress according to claim 10, wherein all the knitted spacer fabrics are covered by precisely one top layer cover.

13. A mattress according to claim 10, wherein a plurality of top layer covers is provided to cover the knitted spacer fabrics.

14. A mattress according to claim 1, wherein the top layer has a moisture-absorbent material layer.

15. A mattress according to claim 1, wherein the top layer has a germicidal material layer.

16. A mattress according to claim 1, wherein the knitted spacer fabric is hot-formed for adaptation to a body shape.

17. A mattress according to claim 1, wherein the top layer has a moisture sensor.

18. A mattress according to claim 1, wherein a ventilation device is provided for ventilating the top layer.

19. A mattress according to claim 4, wherein a plurality of shaped bodies is arranged in a shear-resistant manner one above the other in a y-direction.

20. A mattress according to claim 4, wherein a plurality of shaped bodies is arranged next to one another in an x-direction.

21. A mattress according to claim 1, wherein a suction device is provided for ventilating the top layer.

22. A mattress according to claim 1, further comprising:

a liquid impermeable base layer cover surrounding said base layer, said liquid impermeable base layer cover comprising a top liquid impermeable base layer cover portion, said top liquid impermeable base layer cover portion being adjacent to said liquid-impermeable top layer cover lower part, wherein said two covering layers comprises a spacer fabric first covering layer and a spacer fabric second covering layer, said spacer fabric first covering layer engaging said liquid-permeable top layer cover upper part, said spacer fabric second covering layer engaging said liquid-impermeable top layer cover lower part, said two covering layers being liquid permeable.

23. A mattress, comprising:

a resilient base layer;

a resilient base layer covering structure surrounding said resilient base layer;

a top mattress structure arranged opposite said base layer, said top mattress structure comprising a resilient knitted spacer fabric and a top layer cover covering the knitted spacer fabric, said top layer cover comprising a liquid-impermeable top layer cover lower part facing the base layer and said top layer cover comprising a liquid-permeable top layer cover upper part located at a spaced location from said base layer, said knitted spacer fabric having a first covering layer, a second covering layer and spacer threads located between said first covering layer and said second covering layer, said first covering layer being connected to said second covering layer via said spacer threads, said top layer cover lower part defining a trough for collecting fluids.

24. A mattress in accordance with claim 23, wherein said spacer threads form spacer thread groups extending in a plane, each of said spacer groups comprising at least two parallel spacer threads and at least two intersecting spacer threads, said two parallel spacer threads being perpendicular to said first covering layer and said second covering layer, said two intersecting spacer threads extending obliquely with respect to said two parallel spacer threads, said at least two parallel spacer threads and said at least two intersecting threads defining an IXI-shape, said resilient base layer covering structure being located opposite said resilient base layer covering structure, said first covering layer and said second covering layer being liquid permeable.

* * * * *